US007007405B2

(12) United States Patent
Hajek et al.

(10) Patent No.: US 7,007,405 B2
(45) Date of Patent: Mar. 7, 2006

(54) METHOD OF DRYING BOOK AND SIMILAR PAPER-BASED MATERIALS

(75) Inventors: Milan Hajek, Prague (CZ); Jiri Drahos, Prague (CZ)

(73) Assignee: Ustav Chemických Procesů Akademie Věd Ceské Republiky, Prague (CZ)

( * ) Notice: Subject to any disclaimer, the term of this patent is extended or adjusted under 35 U.S.C. 154(b) by 0 days.

(21) Appl. No.: 10/748,905

(22) Filed: Dec. 30, 2003

(65) Prior Publication Data

US 2004/0177528 A1 Sep. 16, 2004

(30) Foreign Application Priority Data

Dec. 30, 2002 (CZ) ..... PV 2002-4272

(51) Int. Cl.
*F26B 3/34* (2006.01)

(52) U.S. Cl. ..... 34/259

(58) Field of Classification Search ..... 34/259, 34/263

See application file for complete search history.

(56) References Cited

U.S. PATENT DOCUMENTS 4,103,431 A * 8/1978 Levinson ..... 34/259
5,120,500 A 6/1992 Eggersdorfer et al.
5,859,412 A * 1/1999 Yagi ..... 219/704
5,948,311 A * 9/1999 Beecroft et al. ..... 219/762
6,381,869 B1 * 5/2002 Lunan ..... 34/146
6,409,329 B1 6/2002 King

FOREIGN PATENT DOCUMENTS

| | | |
|---|---|---|
| CA | 2009621 | 8/1990 |
| CZ | 12847 | 9/2002 |
| DE | 3904111 | 8/1990 |
| EP | 0 386436 | 1/1990 |
| GB | 2249619 A | 11/1990 |

OTHER PUBLICATIONS

"Foundations and Industrial Applications of Microwave and Radio Frequency Fields" by G. Roussy and J.A. Pearce (pp. 370-387).

* cited by examiner

*Primary Examiner*—S. Gravini
(74) *Attorney, Agent, or Firm*—Collard & Roe, P.C.

(57) ABSTRACT

A method and apparatus for drying book and similar paper-based materials in wet or frozen state, in which the material dried is exposed to microwave irradiation with frequency from 500 MHz to 10 GHz and in which the book or similar paper-based materials is lined with ceramic slabs before the drying. In this arrangement the materials are subsequently exposed to microwaves under atmospheric or reduced pressure. An apparatus for carrying out the method includes microwave drying oven modified for a batch or continuous operation, which includes adjustable ceramic slabs capable to absorb both moisture and microwaves.

5 Claims, 1 Drawing Sheet

METHOD OF DRYING BOOK AND SIMILAR PAPER-BASED MATERIALS

FIELD OF THE INVENTION

The invention relates to a method and apparatus for drying book and similar paper-based material in a wet or frozen condition, according to which the material dried is exposed to microwave irradiation with a frequency from 500 MHz to 10 GHz in a batch or continuous process. Specifically, the invention relates to the salvation of books from flooded libraries, archival artefacts, historic documents, maps, court records, etc., which were submerged into flood water, or otherwise and have been conserved by freezing and it is therefore desirable to get them dry fast and at high quality as soon as possible.

DESCRIPTION OF THE PRIOR ART

The process of saving books and other paper-based materials after having been flooded with water includes usually the steps of partially cleaning them by washing with clean water, putting into plastic bags, and conserving by freezing in freezing halls. In the process of restoration the materials so conserved shall be defrosted, dried, disinfected, and potentially conserved.

At present, classic methods of drying such as hot air drying or drying by humid heat, vacuum drying, or vacuum freeze drying also called lyophilization are employed for that purpose. The drawback of aforementioned classic methods is lower quality of materials dried by a method of hot air and humid heat or low productivity and high expenses when using vacuum drying and vacuum freeze drying. The classic drying is very slow, it runs from the surface to the core of the specimen, books are distorted, pages are getting wavy and stuck together, original book backs and imprints are damaged, which is undesirable especially in the case of historically valuable materials. Although the vacuum drying or lyophilization are less severe they are too costly. For example, in the case of 9,000 tonnes of flooded books their drying would last for several decades when using conventional means. Libraries and other institutions, however, wish to return the books and other paper-based materials to their use as quickly as possible.

It is also known that the most efficient and fastest technology for said purpose is the microwave drying, which was already applied for the drying of various materials as wood, leather, textiles, and including paper (G. Roussy, J. A. Pearce, Foundations and Industrial Applications of Microwave and Radiofrequency Fields, John Wiley & Sons, New York, 1995). In all these cases the materials treated are homogeneous materials having low moisture content. Book and similar materials are, however, of diversified nature concerning contents of various components such as adhesives, prints, colour pictures, gold-plated initials, etc.

For this type of materials a microwave method combined with vacuum was employed as disclosed in the German patent DE 3,904,111 and its equivalents such as U.S. Pat. No. 5,120,500; EU Pat 0386,436, and CA Pat. 2,009,621. This method was mostly applied for the pre-drying of books prior to their deacidification. The moisture content of the books stored was in between 8 and 10% and was reduced to 2% moisture in 30 minutes. This method was found suitable merely for materials with low moisture content or for the application of a lower microwave power, for instance 500 W. With higher moisture content requiring a higher microwave power the books were damaged, namely their different components as adhesives, colour pictures, gold-plated initials and inscriptions, photographs, etc. Where the materials contained metal were present such particles had to be discovered by means of a special detection system and prevented from entering into the drying process due to the hazard of sparking and fire as described in U.S. Pat. No. 6,409,329. Therefore it is obvious that the method of the microwave drying of books and similar materials has significant limitations preventing it from a wider application.

The Czech utility model CZ 12,847 discloses an apparatus—a microwave oven using microwave irradiation for the purpose of drying book and paper-based material within a certain optimum frequency range. Nevertheless, the drying process has to be carried out very carefully and relatively slowly in order to guarantee for its uniform course to exclude overheating or insufficient drying of the materials so dried.

SUMMARY OF THE INVENTION

It is therefore the object of the invention to improve the method of microwave drying book and similar paper-based material in wet or frozen condition by preventing such paper-based material from preheating or insufficient drying and enable thus fast and gentle drying process.

Another object of the invention is to accelerate the drying process and provide a uniform course thereof.

Still another object of the invention is to provide an apparatus for carrying out the method according to the invention.

These and other objects are attained in accordance with the invention wherein the book and similar paper-based material is prior to its exposing to a microwave irradiation lined with ceramic slabs.

An additional aspect of the invention is that the book and similar paper-based material lined with ceramic slabs is exposed to microwave irradiation with a frequency ranging from 500 MHz to 10 GHz preferably 2450 MHz or 915 MHz in a batch or continuous process.

A further aspect of the method according to invention is to carry out the drying process under a pressure ranging from 1 kPa up to the atmospheric pressure.

According to still another aspect of the invention the apparatus for carrying out the above-described method comprises a microwave drying oven adapted for batch and/or continuous processing of a material to be dried and ceramic slabs capable of moisture absorption for contacting the material during the drying process.

To enhance the effect of the method based on the use of ceramic slabs, the ceramic slabs may be shaped by horizontal grooves or vertical holes.

The installed ceramic slabs improve the drying capacity of the microwave field and accelerate the drying process and the uniform course thereof, which prevents the material dried from preheating or insufficient drying. The ceramic slabs are made of a porous material with a high imbibition capacity up to 100%. They are specially shaped either by horizontal grooves or vertical holes in order to enlarge their surface area and therefore the drying effect thereof. When in dry condition they are transparent to microwaves nevertheless their properties and structure enhance the microwave field homogeneity and thus enable to eliminate potential hot spots. Moreover, they have excellent capacity to absorb moisture from the materials dried and thus to reduce the excessive content of water after the defrosting and to accelerate in this way the drying process due to its progress from the centre of a book to the surface thereof.

The use of reduced pressure from the atmospheric one down to 1 kPa accelerates the drying and enables to reduce the drying temperature to 30 through 50° C. and contributes thus to the gentle effect of the process.

Other characteristic of the method is the selective drying effect of the slabs by which the microwaves effect only moisture i.e. water contained in the material without regard to the diversity of the materials dried (adhesives, colour pictures, gold-plated initials and inscriptions, photographs, as well as metal particles). This process of uniform and gentle drying books and any other paper-based material may be carried out at high speed while high quality of the dried materials is maintained without causing any damage to the materials even though a higher microwave power is applied. The method is applicable and effective even for paper-based materials with high imbibition capacity up to 300%, i.e. with 3 times higher water content than the dry matter content, both in a batch arrangement as well as a continuous one and under atmospheric pressure as well as under a sub-atmospheric pressure. Due to the sterilising character of microwave irradiation the materials dried are simultaneously disinfected so that fungi, bacteria, and other aetiological agents are destroyed. Thus the method according to the invention guarantees that the materials preserved would return to libraries, archives, and museums in their original state and at a high quality for their further usage in a short time.

DETAILED DESCRIPTION OF THE PREFERRED EMBODIMENT

Figure 1:
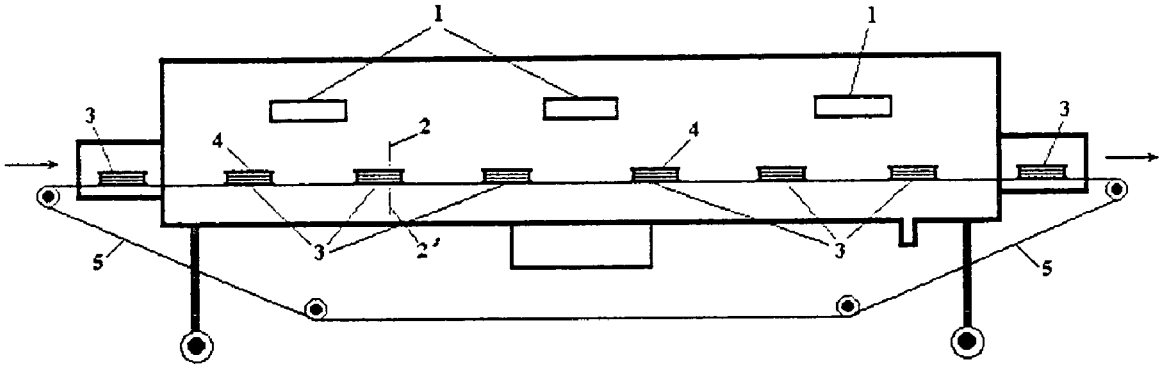
FIG. 1 shows a drying oven according to the invention.
Figure 2:
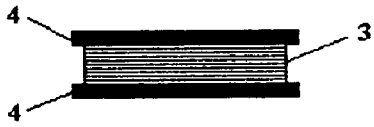
FIG. 2 shows a section view along line 2–2' of FIG. 1.

Turning now in detail to the drawing, the drying oven includes means for microwave drying 1 with a total power of 8 kw arranged along an elongated box adapted to receive a conveyer 5 with the upper portion of its endless belt passing through the box. Each book or stack of paper material 3 is lined on its upper side and lower side with ceramic slabs 4 which are disposed on the belt conveyer 5.

EXAMPLE 1

Books containing 50–100% water, in wet or frozen state, were put into a batch microwave drying oven using a frequency of 2450 MHz and power 4 kW. The books occupied a space up to 50 litres and were arranged up to 100 mm thick layer and up to 500 mm in width. The books were lined on the upper and lower side with ceramic slabs of a porous material 10 mm in thickness having the water absorption capacity up to 100%. The slabs were provided with horizontal grooves and vertical holes in order to increase water absorption and to accelerate the drying process.

Thereafter the books were exposed to a microwave field equivalent to 0.1–1.0 kW/kg book. at a temperature control from 40 to 70° C. by IR pyrometer. After 30 to 60 minutes, depending on their size and water content, the books were dried, taken out and replaced by a new batch.

EXAMPLE 2

Wet or frozen books or other paper-based materials sized as in the Example 1 lined with ceramic slabs 5 to 15 mm thick, depending on the thickness of the paper layer, were inserted at the inlet of a belt conveyor running into a continuous microwave drying oven operating at a frequency of 915 MHz and power 12 kW, and the materials pass through a drying tunnel at a velocity of 0.1–1.0 m/min, for example. After passing the defrosting, drying, and sterilisation zones in total duration of 5 to 20 minutes the dried books were replaced by a new specimen and insufficiently dried books were automatically returned back into the drying process. The drying rate was controlled by the velocity of the belt and by adjusting the microwave power. The resulting dried material left the oven in the sterilised condition.

EXAMPLE 3

Wet or frozen books lined with ceramic slabs as in Example 1 or 2 were inserted into a discontinuously operated microwave drying oven using a frequency 2450 MHz and power 16 kW. The oven was closed and its internal drying room was evacuated to a pressure of 10–50 kPa. The microwave irradiation combined with reduced pressure (vacuum) caused very fast drying under very mild conditions (30–50° C.) yielding finally uniformly dried material.

INDUSTRIAL APPLICABILITY

The invention is, first of all, designed to the salvation of books and paper-based materials, which were submerged in flood water for a certain time and have been stored frozen till their recovery by defrosting, drying, and sterilization.

What is claimed is:

1. An apparatus for continuous drying of books and similar paper-based material comprising a microwave drying oven operating at a frequency of 915 to 2450 MHz;

ceramic slabs for lining said books or paper material on an upper side and a lower side; and absorbing moisture when contacting the books or material during the drying process; and wherein the ceramic slabs are provided with horizontal grooves and vertical holes;

a continuous belt conveyor for receiving said lined books or material and arranged to pass through said oven; and means for adjusting the oven power supply and the speed of the belt conveyor when passing through the microwave oven.

2. A method for continuous drying of books and similar paper-based material in which the material dried is exposed to microwave irradiation with a frequency ranging from 500 MHz through 10 GHz comprising the steps of:

lining the material with ceramic slabs on an upper side and a lower side and absorbing moisture when contacting the books or material during the drying process; and wherein the ceramic slabs are provided with horizontal grooves and vertical holes;

exposing lined material to microwave irradiation in a continuous microwave drying oven under atmospheric pressure or a reduced atmospheric pressure; and controlling the drying rate by adjusting a power supply and an advancing speed of the lined material in the oven to keep the temperature of the material in a range of 30–70° C.

3. A method of claim 2, wherein the microwave irradiation is carried out at a frequency of 2450 MHz or 915 MHz.

4. A method of claim 2, wherein the drying is carried out under a pressure ranging from 1 kPa to the atmospheric pressure.

5. A method of claim 4, wherein the drying is carried out at a temperature from 30 to 70° C.

* * * * *